US005204151A

United States Patent [19]

Svehaug

[11] Patent Number: 5,204,151

[45] Date of Patent: Apr. 20, 1993

[54] MARTIAL ARTS BOARD

[76] Inventor: Oswald C. Svehaug, 1010 San Ysidro Blvd., San Ysidro, Calif. 09173

[21] Appl. No.: 933,120

[22] Filed: Aug. 21, 1992

Related U.S. Application Data

[63] Continuation-in-part of Ser. No. 775,018, Oct. 11, 1991.

[51] Int. Cl.[5] ..... B32B 3/06

[52] U.S. Cl. ..... 428/60; 428/58; 428/192; 482/83

[58] Field of Search ..... 428/58, 60, 81, 99, 428/192, 136; 482/83

[56] References Cited

U.S. PATENT DOCUMENTS

| | | | |
|---|---|---|---|
| 3,973,772 | 8/1976 | Milliken | 428/83 |
| 4,497,858 | 2/1985 | Dupont et al. | 428/60 |
| 4,842,905 | 6/1989 | Stech | 428/58 |

*Primary Examiner*—Alexander S. Thomas
*Attorney, Agent, or Firm*—Henri J. A. Charmasson

[57] ABSTRACT

A reusable martial arts board comprises two interconnecting and symmetrical half-sections. Along the interconnecting edge of each section a plurality of alternating projections and cavities are shaped and dimensioned to intimately engage a matching row of similar projections and cavities on the opposite board. Each cavity has a slot in its lower section, and each projection has a corresponding radial groove. When a load is applied at the junction of the board being held at opposite ends, the slots expand while the grooves constrict to facilitate the separation of each extension from its nesting cavity. A cushioning pad is mounted under each half-section, along its outer edge, for the comfort of the person holding the martial board.

5 Claims, 4 Drawing Sheets

MARTIAL ARTS BOARD

PRIOR APPLICATION

This is a continuation-in-part of co-pending application Ser. No. 07/775,018 filed Oct. 11, 1991.

FIELD OF THE INVENTION

This invention relates to releasable fasteners used to form breakable joints between two boards, and in particular to reusable martial arts training boards which can be split into halves when struck by hand.

BACKGROUND OF THE INVENTION

Many martial arts, especially those of oriental origin teach the use of blows applied with the edge of the hand, such as the karate chop to disable an opponent. These chops are practiced on boards supported at opposite ends. The martial arts enthusiast is trained to strike the middle of the board with the edge of his outstretched hand in an effort to break the board in its middle section. Boards of various thickness are used according to the practitioner's proficiency. Many such boards may be broken during a practice session at heavy cost and waste of valuable material.

It would be advantageous to have a reusable martial arts training board which would break while stricken with a given degree of force, but could be reassembled and reused without any substantial loss of strength.

SUMMARY OF THE INVENTION

The principal and secondary objects of the invention are to provide a reusable martial arts board that will come apart in the middle when struck with a predictable degree of force, and yet can be reassembled and reused without any substantial loss of holding power.

These and other valuable objects are achieved by a board made in two symmetrical halves from a synthetic material. The breakable joint between the sections is provided by a series of alternating pegs and pokes along the interconnecting edges of each section. Minute breaks in the continuity of the holding elements facilitate their separation under a specific load. The total load required to break the board can be adjusted by offsetting the two sections within their own planes, thus reducing the number of interconnecting pegs and pokes between the two sections.

DESCRIPTION OF THE PREFERRED EMBODIMENT OF THE INVENTION

Figure 1:
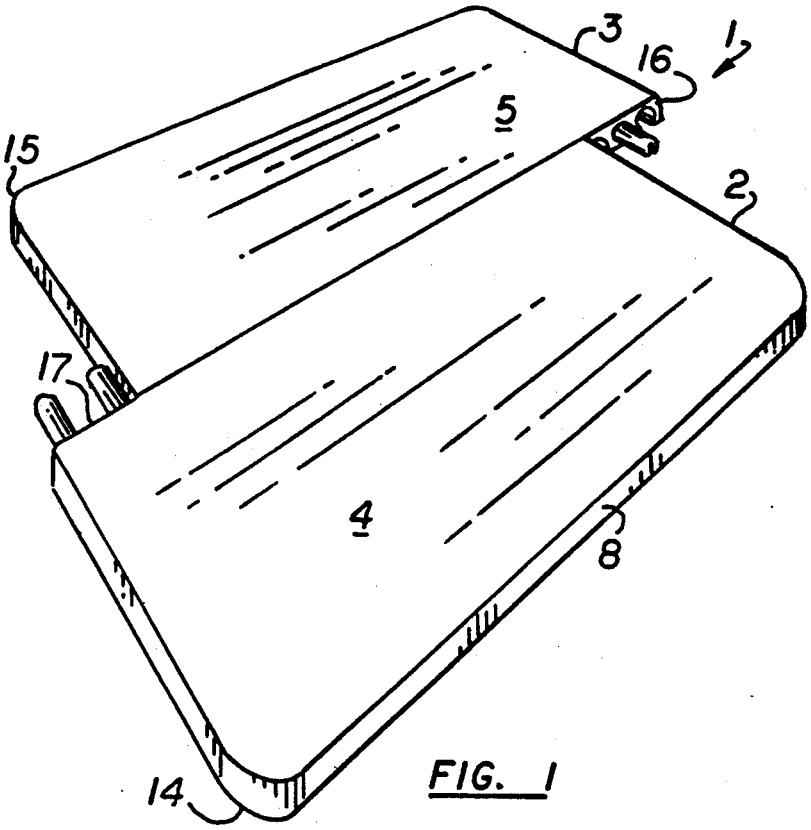
FIG. 1 is a perspective view of a martial arts reusable board adjusted for a specific load.
Figure 3:
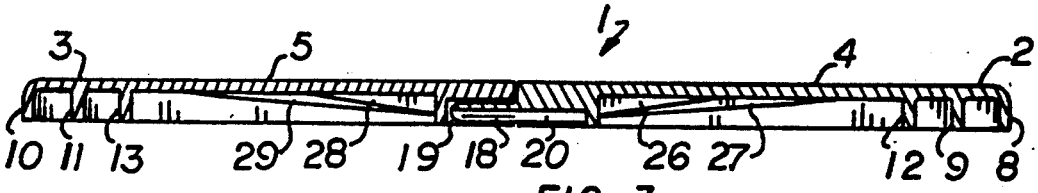
FIG. 3 is a cross-sectional view taken along line 3—3 of FIG. 2.
Figure 4:
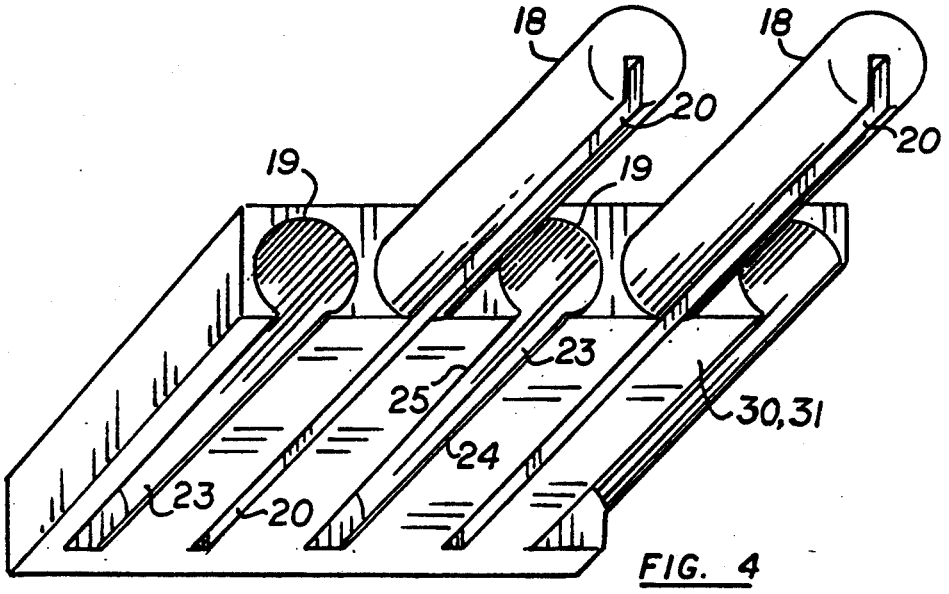
FIG. 4 is a perspective view of a segment of the interconnecting elements.
Figure 2:
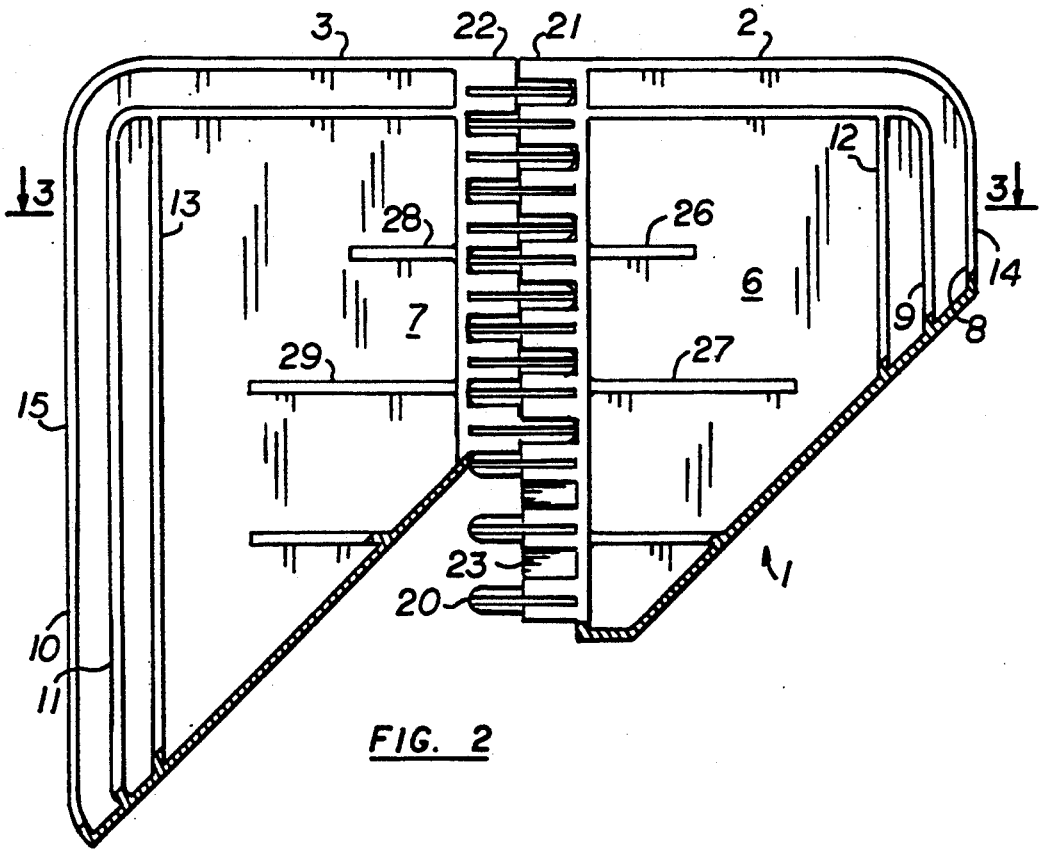
FIG. 2 is a bottom plan view of a board with cut-out exposing the interconnecting structure.
Figure 5:
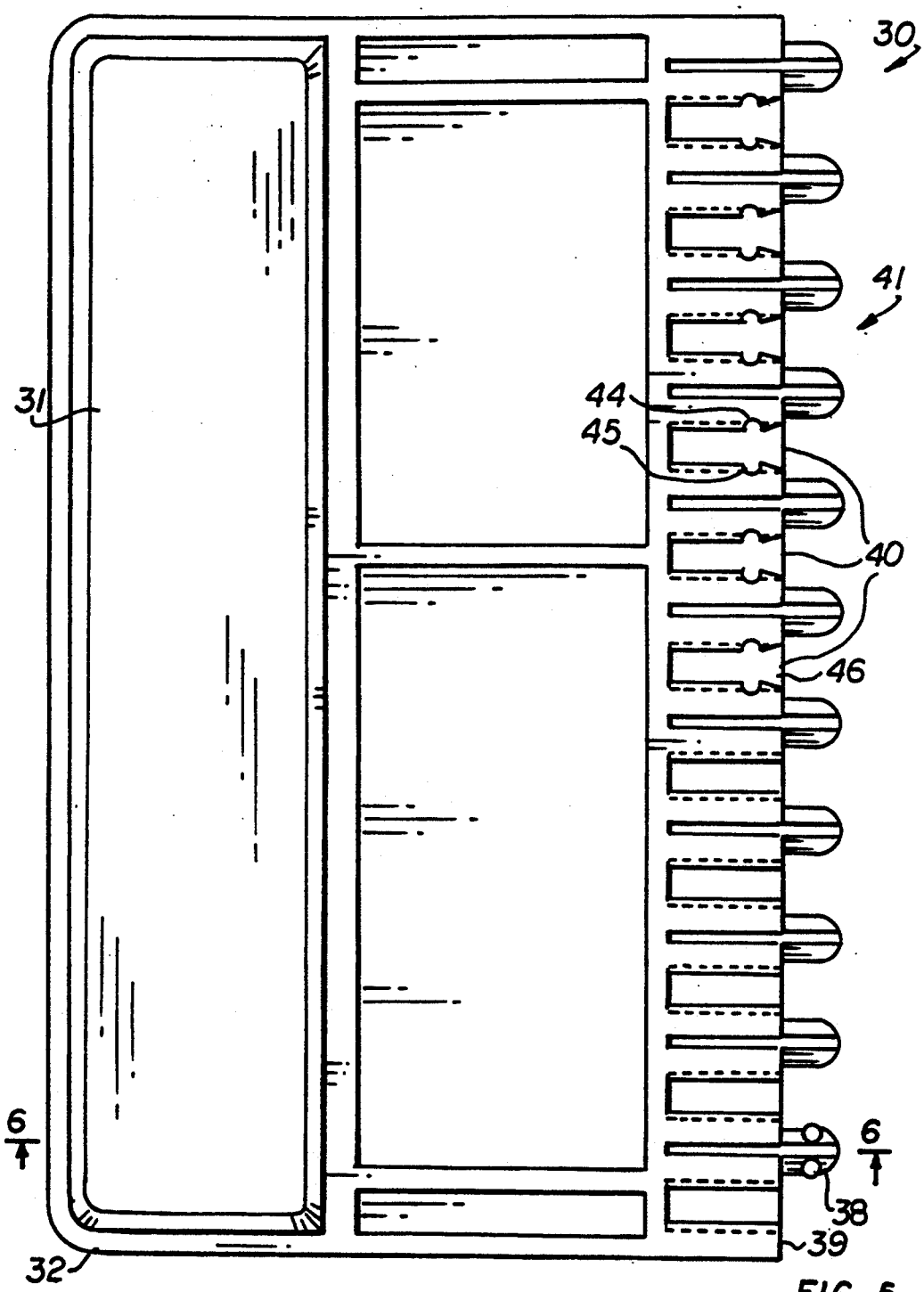
FIG. 5 is a bottom plan view of an alternate embodiment of the martial arts board.
Figure 6:
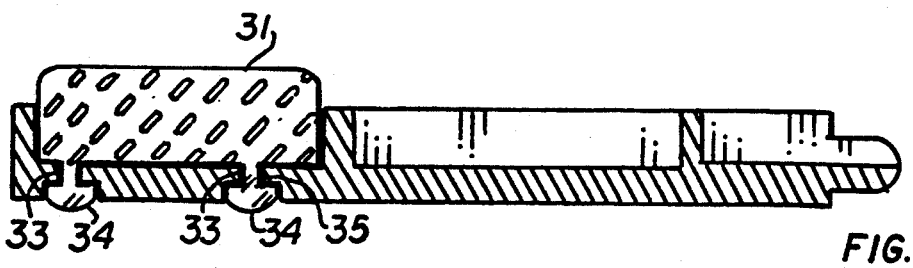
FIG. 6 is a cross-sectional view thereof taken along line 6—6 of FIG. 5.

Referring now to the drawing, there is shown a reusable martial arts training board 1 comprising two symmetrical interconnecting half sections 2, 3 which are preferably molded out of nylon material. Each of the two symmetrical half sections has a smooth, flat top surface 4, 5. The undersides or bottom surfaces 6, 7 are similarly flat but ringed around their periphery by a pair of reinforcing ribs 8, 9 and 10, 11 with additional reinforcing ribs 12, 13 along the lateral edge 14, 15 at which the board is supported when it is used. Along the opposite internal edge 16, 17 of each half section, the interconnecting structure comprises alternating sequences of projecting pegs or tenons 18 and pokes or mortises 19. Each tenon is cylindrical and has a radial groove 20 which runs vertically from its lowermost area to the center of the tenon. The groove extends along the entire length of the tenon and into the thickened marginal section 21, 22 of the supporting edge into which the mortises 19 are cut or drilled. The mortises are cylindrical cavities shaped and dimensioned to intimately engage the pegs of the other half section. The periphery of each mortise is tangential to the bottom surface 30, 31 of the marginal section 21, 22. A slot 23 cut into the lower part of each cavity consequently opens into that underside. The slot 23 extends over the entire length of the cavity and has a width approximately between 1/5 and ¼ of the cavity perimeter, i.e., over an arc of 72 to 90 degrees. The width of each tenon groove 20 is approximately ½ of its depth, i.e., half the cross radius of the tenon. Since the sequence of pegs and pokes are symmetrically sized, parallel, and regularly spaced apart, the two half sections 2, 3 can be brought together and joined evenly as illustrated in FIG. 2. In that arrangement every peg 18 of a half section is engaged into a corresponding poke 19 of the other half section. Alternately, and in order to adjust the breaking characteristic of the board, the two half sections 2, 3 can be offset by a certain number of peg-and-poke interface as illustrated in FIG. 1. The groove 20 of each peg lends a certain degree of resiliency under constriction. Similarly, the edges 24, 25 of each slot 23 at the base of each cavity are slightly flexible due to their tapered configuration resulting from the tangential position of the cavity of the underplane 30, 31 of the marginal section. These edges tend to give slightly under pressure allowing the escape of the peg when the median top surface of the board is subject to a blow. The multiplicity of the peg-and-poke interfacing elements combined with their individual resiliency results in a very constant and ascertainable breaking point at which the two half sections will separate when the board is hit in its center while being supported along its lateral edges 14, 15. The ascertainable breaking point can be accurately determined for various offset positions of the two half sections such as the one illustrated in FIG. 1. Accordingly, the board is a convenient martial arts training device whose resistance to impact can be adjusted according to the strength or skill of the practitioner. In addition, when the board breaks up under blows it emits a sharp noise not unlike the breaking noise of a wood plank.

A plurality of triangular gussets 26, 27, 28 and 29 are used to reinforce each section by bracing the marginal sections 21, 22 in the bottom surface 6, 7 of each half section.

The board is substantially square, with each side measuring approximately 25 centimeters. The interface consists of ten tenons and ten mortises with a cross diameter of approximately one centimeter and a length or depth of two centimeters.

An alternate embodiment 30 of the invention is illustrated in FIGS. 5–8. This alternate embodiment provides a broader range of impact resistance, better resistance consistency over the life of the board, and more convenient and comfortable handling. The latter feature can be attributed to the addition of a resilient pad 31 along the outer edge 32 of the underside of each half section of the board.

The pad molded out of synthetic rubber is held by a series of stubs 33 with flattened heads 34 that are engaged into a series of corresponding bores 35 in the board 30. The pad contributes to a more convenient and comfortable handling of the martial board during exercise.

Figure 8:
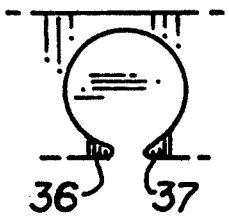
FIG. 8 is a partial end-view of an alternate poke configuration.

The alternate embodiment is further characterized by the rounded edges 36, 37 of each slot as shown in FIG. 8. This rounded configuration of the slots edges is less susceptible to wear over the life of the board, and therefore results in a more predictable and constant resistance to separation upon impact.

Figure 7:
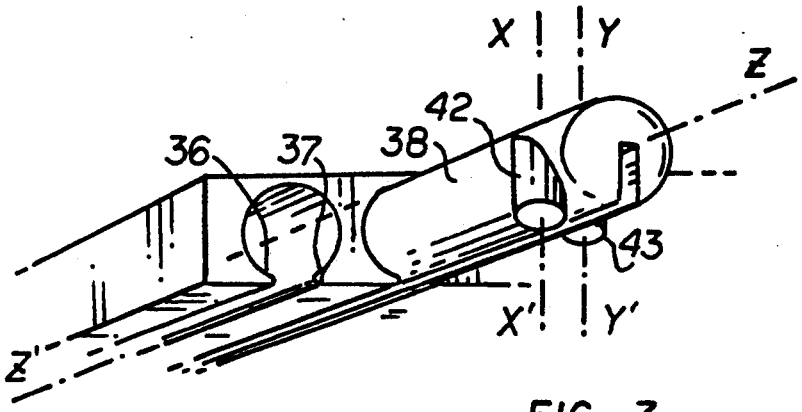
FIG. 7 is a perspective view of an alternate peg.

The range of adjustable resistance to separation upon impact is greatly expanded by the presence of a specially configured peg 38 at one end 39 of each half section of the board, and a series of specially configured pokes 40 over the opposite half 41 of the half-section. The specially configured peg 38, more specifically illustrated in FIG. 7, is characterized by a pair of small cylindrical protrusions 42, 43 located outside of a distal section near the tip of the prong. The protrusions axes X,-X' and Y'-Y are parallel to each other but perpendicular to the axis Z-Z' of the peg. The specially configured pokes 40 have corresponding pairs of semi-circular notches 44, 45 in a median section of its slots designed to accommodate the corresponding protrusions 42, 43 of the specially configured peg 38 mounted on the other half-section of the board. The section 46 of the slot ahead of the notches is enlarged into a V-shaped aperture tapering toward the notches.

The combination of the protrusions 42, 43 and notches 44, 45 not only provide a positive locking of the two half-sections of the martial art board, but also yield a more constant and predictable resistance to separation upon impact. Moreover, by off-setting the relative position of the two half-sections as was earlier explained and illustrated in FIG. 1, the specially configured peg 38 may or may not be used depending upon which end of the half-board is off-set, thus enlarging the range of impact resistance adjustment.

While the preferred embodiments of the invention have been described, modifications can be made and other embodiments may be devised without departing from the spirit of the invention and the scope of the appended claims.

What is claimed is:

1. A reusable martial arts board which comprises:

two symmetrical half-portions, each half-portion comprising:

a planar quadrangular slab having substantially flat top and bottom surfaces;

along a connecting edge, a plurality of alternating and parallel male and female interconnecting elements wherein each of said male interconnecting elements is shaped and dimensioned to intimately nest into one of said female interconnecting elements;

each of said female elements comprising a circular, tubular cavity having a slot opening into said bottom surface;

each of said male elements comprising a cylindrical projection having a solid core and a radial groove opening into an underside section of said projection;

wherein the periphery of said tubular cavity is tangential to said bottom surface; and said slots comprise rounded edges.

2. The structure of claim 1, wherein one of said male elements located proximally to one lateral end of said connecting edge comprises a pair of lateral protrusions astride a distal section of said male elements; and each of a plurality of said female elements located at an opposite lateral end of said connecting edge has a pair of notches along a median section of said slot, said notches being positioned, shaped and dimensioned to intimately engage said protrusions.

3. The structure of claim 2, wherein said plurality of female elements are located over one half section of said connecting edge.

4. The structure of claim 2, wherein said slot has an enlarged aperture tapering toward said notches.

5. The structure of claim 1, which further comprises a pad of resilient material attached to the bottom surface proximate an outer edge of said slab opposite said connecting edge.

* * * * *